United States Patent [19]

Steiner

[11] Patent Number: 4,793,521

[45] Date of Patent: Dec. 27, 1988

[54] DEVICE FOR DISPENSING FLUENT MATERIALS FROM CARTRIDGES

[76] Inventor: Andy Steiner, 2309 11th St., Two Rivers, Wis. 54241

[21] Appl. No.: 143,372

[22] Filed: Jan. 13, 1988

[51] Int. Cl.[4] ..... B05B 11/02

[52] U.S. Cl. ..... 222/156; 222/181; 222/327; 222/387; 222/390

[58] Field of Search ..... 222/181, 185, 325–327, 222/387, 390, 391, 392, 402.12, 544, 559–561, 156, 157

[56] References Cited

U.S. PATENT DOCUMENTS

| | | | |
|---|---|---|---|
| 1,274,957 | 8/1918 | Tibbals | 222/390 X |
| 1,761,875 | 6/1930 | Cordell et al. | 222/390 X |
| 2,080,343 | 5/1937 | Smith | 222/390 X |
| 2,145,779 | 1/1939 | Puderbaugh | 222/392 X |
| 2,294,954 | 9/1942 | Brady | 222/390 X |
| 2,533,282 | 12/1950 | Osman | 222/387 |
| 3,220,616 | 11/1965 | Jennings | 222/392 X |
| 3,854,629 | 12/1974 | Blieberger | 222/333 X |
| 4,046,288 | 9/1977 | Bergman | 222/390 X |
| 4,299,336 | 11/1981 | Studer | 222/387 X |
| 4,615,469 | 10/1986 | Kishi et al. | 222/327 |

*Primary Examiner*—Kevin P. Shaver
*Attorney, Agent, or Firm*—Jerry T. Kearns

[57] ABSTRACT

A dispenser for soap, shampoo, tooth paste, etc. has a housing with a removable cover for the reception of disposable refill cartridges. A plunger within the dispenser is caused to advance axially by a rack and pinion mechanism to dispense the contents of the refill cartridge from an opening in the bottom of the housing. Both the plunger and a door covering the dispensing opening are actuated by manipulation of a single knob. The housing is provided with mounting bosses for securing the dispenser on a wall with conventional threaded fasteners.

10 Claims, 3 Drawing Sheets

DEVICE FOR DISPENSING FLUENT MATERIALS FROM CARTRIDGES

BACKGROUND OF THE INVENTION

1. Field of the Invention

The present invention relates to dispensers, and more particularly pertains to a new and improved dispenser for use with replaceable refill cartridges of soap, shampoo, tooth paste, etc. Presently, the previously described items are purchased by the consumer in individual containers. In order to use these products, the consumer must first locate the container, and then fumble with the container to access the contents. There is no precise method of regulating the amount of the contents to be dispensed. The necessity of maintaining a separate bottle or tube for each of the items unnecessarily clutters the home and particularly the bathroom of the consumer. Additionally, the bottles and tubes are relatively expensive to manufacture because they must be relatively durable to withstand repeated handling. In order to overcome these problems, the present invention provides a dispenser designed to dispense various liquids and pastes from disposable refill cartridges. It is contemplated that the dispenser will be mounted on a bathroom wall, or within a shower, and utilize drop in refill cartridges. These cartridges need not be expensive or durable as they will be received within the dispenser housing. The contents of the cartridge may be dispensed by a one handed operation of a knob on the dispenser.

2. Description of the Prior Art

Various types of dispensers are known in the prior art. A typical example of such a dispenser is to be found in U.S. Pat. No. Des. 41,789, which issued to G. Stack on Sept. 19, 1911. This patent discloses a dispenser for soap powder having a generally cylindrical housing and a top plunger for dispensing soap powder through an opening in the bottom of the dispenser. A bracket is provided for mounting the dispenser on a wall. U.S. Pat. No. Des. 117,061, which issued to W. Finnell on Oct. 10, 1939, discloses a soap dispenser which is provided with a wall mounting bracket. A hinged cover is provided at the top of the dispenser for refilling the contents. A rotatable knob is provided to actuate the dispenser. U.S. Pat. No. Des. 177,457, which issued to H. Cortner on Apr. 17, 1956, discloses a generally trapezoidal shaped dispenser having a removable top cover for refilling the dispenser. A knob extending through a front face of the dispenser is utilized to dispense the desired quantity from the dispenser. U.S. Pat. No. Des. 245,891, which issued to B. Milbourne Jr. on Sept. 27, 1977, discloses an irregularly shaped dispenser having a plunger type actuator. U.S. Pat. No. 2,932,431, which issued to N. Lipton on Apr. 12, 1960, discloses a tooth paste dispenser. This dispenser utilizes a pair of meshing rollers for squeezing the contents from a conventional tube of tooth paste.

While the above mentioned devices are suited for their intended usage, none of these devices provides a dispenser suitable for use with disposable refill cartridges. Further, none of the aforesaid dispensers simultaneously actuate a dispensing plunger and open a dispensing door by one handed manipulation of a single control knob. An additional feature of the present invention not contemplated by the aforesaid devices is the use of a rack and pinion actuated dispensing plunger to dispense the contents of a disposable refill cartridge.

Inasmuch as the art is relatively crowded with respect to these various types of dispensers, it can be appreciated that there is a continuing need for and interest in improvements to such dispensers, and in this respect, the present invention addresses this need and interest.

SUMMARY OF THE INVENTION

In view of the foregoing disadvantages inherent in the known types of dispensers now present in the prior art, the present invention provides an improved dispenser. As such, the general purpose of the present invention, which will be described subsequently in greater detail, is to provide a new and improved dispenser which has all the advantages of the prior art dispensers and none of the disadvantages.

To attain this, a representative embodiment of the concepts of the present invention is illustrated in the drawings and makes use of a generally rectangular two piece dispenser housing having a removable top section for insertion of rectangular refill cartridges. The refill cartridges are provided with a dispensing opening in one end and a movable bottom portion which is advanced by a plunger within a dispenser for forcing the contents of the cartridges out the dispensing opening. The dispenser includes a bottom opening covered by a door for stopping the flow of the contents of the refill cartridge from the dispenser. Another feature of the present invention is the concurrent actuation of both the dispenser opening door and the dispensing plunger by actuation of a single control knob. The control knob is connected to a transversely extending shaft which is keyed to a pinion which meshes with a rack formed on a stem of the plunger. The dispenser door, which is formed as a flat flexible strip, is also connected to the control knob shaft. By first depressing the control knob, the door is opened and the pinion is meshed with the plunger rack. By now rotating the control knob, a plunger is caused to advance axially, thus forcing the contents from the refill cartridge.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dispenser which has all the advantages of the prior art dispensers and none of the disadvantages.

It is another object of the present invention to provide a new and improved dispenser which may be easily and efficiently manufactured and marketed.

It is a further object of the present invention to provide a new and improved dispenser which is of a durable and reliable construction.

An even further object of the present invention is to provide a new and improved dispenser which is susceptible of a low cost of manufacture with regard to both materials and labor, and which accordingly is then susceptible of low prices of sale to the consuming public, thereby making such dispensers economically available to the buying public.

Still yet another object of the present invention is to provide a new and improved dispenser which provides in the apparatuses and methods of the prior art some of the advantages thereof, while simultaneously overcoming some of the disadvantages normally associated therewith.

Still another object of the present invention is to provide a new and improved dispenser for soap, tooth paste, shampoo, and the like which utilizes disposable refill cartridges.

Yet another object of the present invention is to provide a new and improved dispenser which utilizes disposable refill cartridge and is susceptible of one handed operation.

Even still another object of the present invention is to provide a new and improved dispenser which has a dispensing plunger and a dispensing door which are concurrently actuated by a single control knob.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
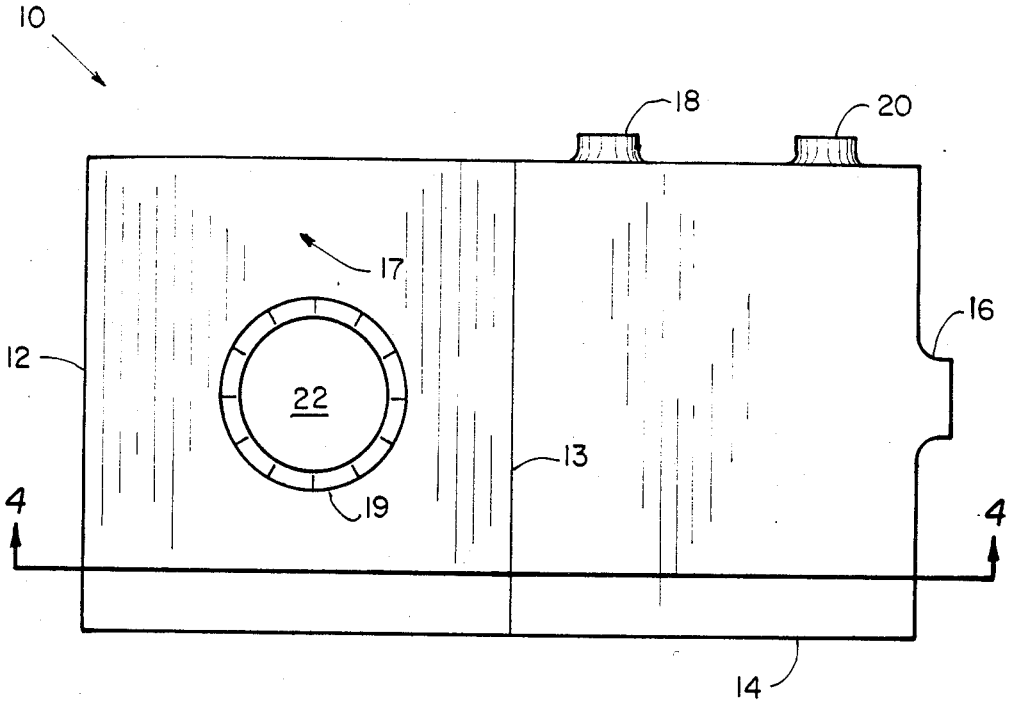
FIG. 1 is a plan view of the front face of the dispenser of the present invention.

With reference now to the drawings, and in particular to FIG. 1 thereof, a new and improved dispenser embodying the principles and concepts of the present invention and generally designated by the reference numeral 10 will be described.

More specifically, it will be noted that the first embodiment 10 of the invention includes a housing formed from a removable top section 12 joined at 13 to a bottom section 14. The dispenser housing is of a generally rectangular configuration, having a dispenser opening 16 formed in a bottom face of the housing section 14. The bottom dispenser housing section 14 is designed to be secured to a wall by conventional threaded fasteners extending through mounting bosses 18 and 20. The top section 12 is removable by lifting upwardly to refill the contents of the dispenser. A control knob 22 for actuating the dispenser extends through the front face of the removable top housing portion 12. Indicia 19 imprinted on the circular periphery of the control knob 22 cooperate with an indicator pointer 17 on the front face of the housing portion 12. This permits an operator to select a precisely determined quantity to be dispensed.

Figure 2:
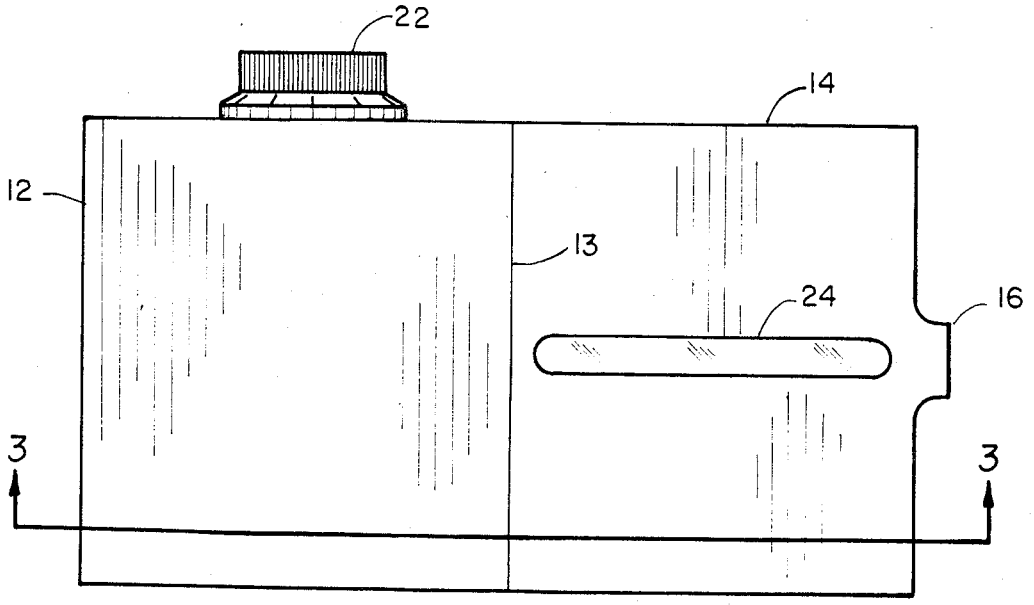
FIG. 2 is a side plan view of the dispenser of the present invention.

As shown in FIG. 2, a sight glass 24 is provided on one side face of the lower housing portion 14. This permits monitoring of the remaining contents of a disposable refill cartridge received within the dispenser housing bottom portion 14.

Figure 3:
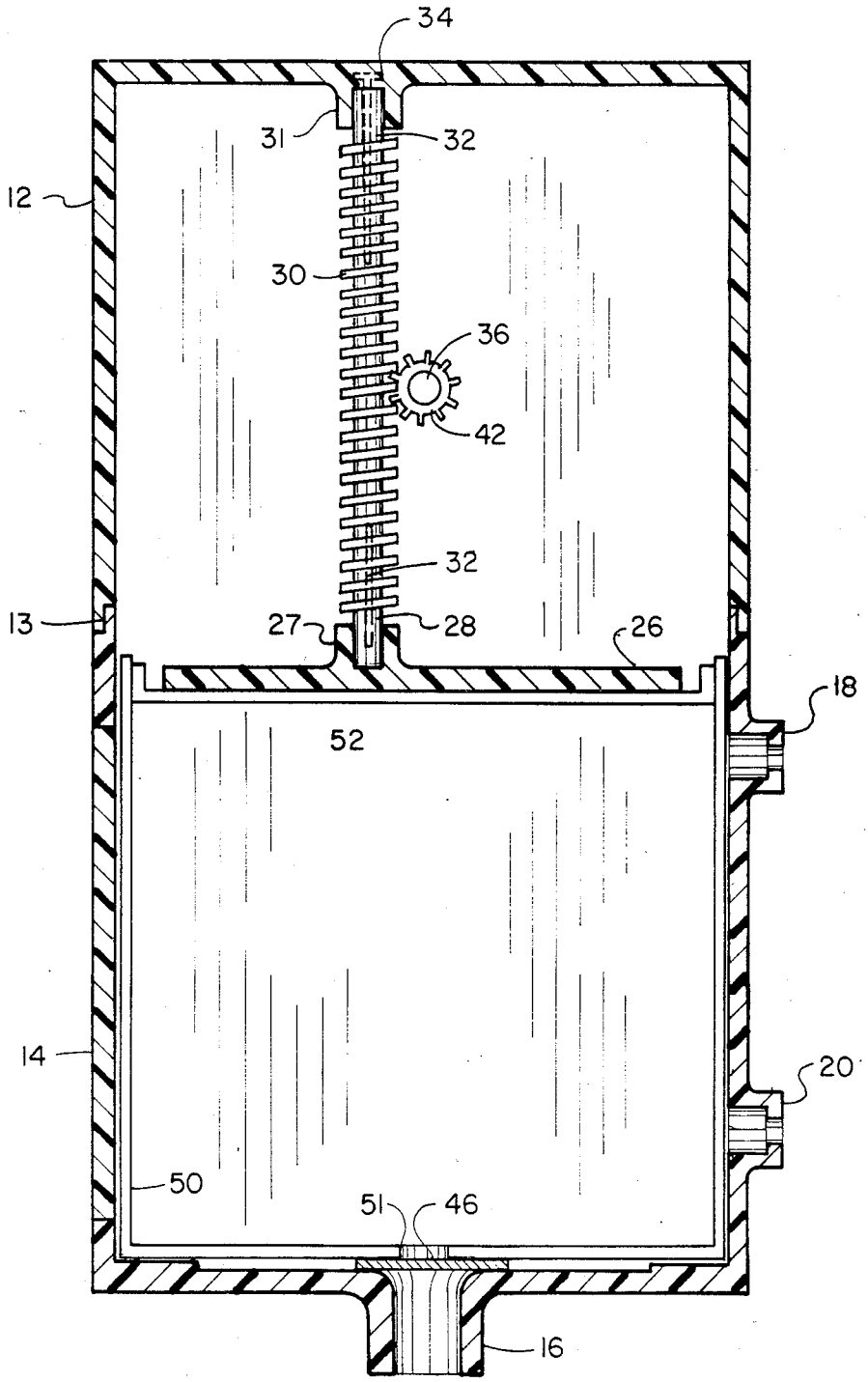
FIG. 3 is a cross sectional view of the dispenser of the present invention taken along lines 3—3 of FIG. 2.

With reference now to FIG. 3, the internal mechanism of the dispenser 10 of the present invention will now be described. A plunger 26 of a generally rectangular configuration is mounted for axial movement with a plunger stem 28 at a boss 27 formed on the rear face of the plunger 26. Plunger stem 28 has a central bore which is telescoped over a stationary mounting pin 32. The stationary mounting pin 32 has a transversely extending headed portion 34 which is received in a slot in the top wall of the upper housing portion 12. The plunger stem 28, when extended to an axially raised position, is received within a boss 31 formed on the inner face of the top wall of the housing portion 12. A gear rack section 30 is formed on the plunger stem 28 for axial movement therewith. A pinion 42 is keyed for rotation with a transversely extending shaft 36. It will now be readily understood that by rotation of the shaft 36 the pinion 42, meshing with the gear rack 30 on the plunger stem 28, will cause a downward axial movement of the plunger stem 28 and hence, the plunger 26. The plunger 26 abuts an axially slidable rear wall 52 of a generally cubical refill cartridge 50. The refill cartridge 50 is provided with an aperture 51 for the dispensing of the contents thereof. The aperture 51 is in registry with the dispensing opening 16 of the lower housing portion 14. A slidable door 46, which is formed from a thin flat strip of flexible material, is opposed between the aperture 51 of the refill cartridge 50 and the dispenser opening 16 on the dispenser housing bottom portion 14. Thus, by sliding the door 46, the aperture 51 of the refill cartridge 50 may be opened. By now rotating the shaft 36 causing downward axial movement of the plunger 26, the rear wall 52 of the refill cartridge 50 will be pushed downwardly, forcing a quantity of the contents of the refill cartridge 50 through the aperture 51 and out the dispenser opening 16.

Figure 4:
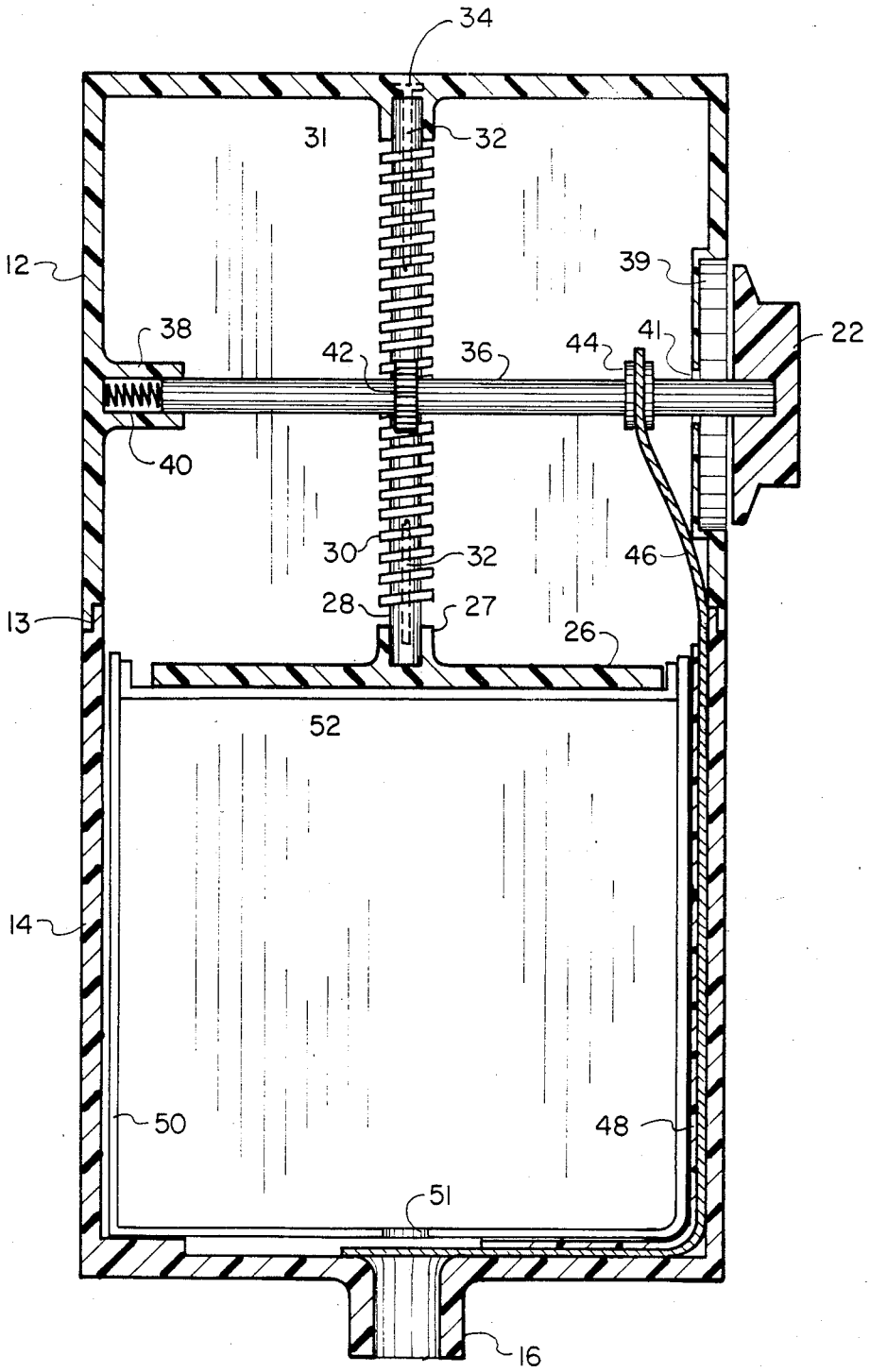
FIG. 4 is a cross sectional view of the dispenser of the present invention taken along lines 4—4 of FIG. 1.

With reference now to FIG. 4, the manner of actuation of the slidable door 46 and the pinion 42 will now be described. The control knob 22 is secured for rotation with a transversely extending shaft 36 which extends through an opening 41 formed in the front face of the upper housing portion 12. An opposite end portion of the shaft 36 is slidably received within a boss 38 formed on an inner back wall of the upper housing portion 12. A spring 40 within the boss 38 biases the shaft 36 toward the front face of the dispenser housing portion 12. The door 46 which, as previously mentioned, is formed from a thin flat strip of flexible material, has an aperture through which the shaft 36 extends. The door 46 is secured against movement along the shaft 36 by a pair of lugs 44 on the shaft 36.

With reference now to FIG. 4, the manner of the operation of the dispenser 10 of the present invention will now be described. The upper housing portion 12 is removed from the lower housing portion 14 which has been previously secured to a wall by the previously described mounting bosses 18 and 20. A refill cartridge 50 containing the desired item, is inserted within the lower housing portion 14. The upper housing portion 12 is then replaced and the dispenser 10 of the present invention is now ready for use. To actuate the dispenser, the control knob 22 is depressed into a recess 39 on the front face of the upper housing portion 12, causing the shaft 36 to be moved toward the rear wall of the upper housing portion 12 against the bias of the spring 40. A this point, the pinion 42 is in engagement with the gear rack 30 on the piston stem 28. Also, the lugs 44 force the flexible door 46 to the left as shown in FIG. 4, thus causing the door 46 to be slid upwardly in a channel formed by a flange 48. This causes the lower end of the door 46 to be slid from registry with the refill cartridge aperture 51, thus opening the aperture for communcation with the dispenser opening 16. By now rotating the control knob 22 in a clockwise direction, the plunger 26 will be caused to move axially downwardly, thus forcing the rear wall 52 of the refill cartridge 50 downwardly and dispensing a desired quantity of the contents through the aperture 51 and the dispenser opening 16. The operator may regulate the quantity dispensed by observing the indicia 19 on the control knob 22 in conjunction with the indicator 17 on the front face of the upper housing portion 12 (FIG. 1). When the desired quantity of the contents of the refill cartridge 50 have been dispensed, the operator merely releases the control knob 22. The spring 40 then moves the shaft 36 to the right, moving the pinion 42 out of engagement with the rack section 30 and causing the flexible door 46 to be slid downwardly between the refill cartridge aperture 51 and dispenser opening 16, thus preventing the egress of any further contents from the dispenser.

When it is desired to refill the dispenser 10 of the present invention, the upper housing portion 12 is merely removed by disconnecting the joint 13 from the lower housing portion 14, the now spent refill cartridge 50 is removed and replaced by a new refill cartridge 50 and the upper housing portion 12 is now replaced. It should be noted that the plunger 26 and the associated actuating mechanism are secured to the upper housing portion 12 and are removed and replaced therewith.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by LETTERS PATENT of the United States is as follows:

1. A dispenser for soap, shampoo, tooth paste, and the like, comprising:
   housing means;
   dispensing opening means in said housing means;
   disposable refill cartridge means having a content to be dispensed removably received in said housing means, said cartridge means having an aperture in alignment with said dispensing opening means;
   door means for selectively opening and closing said opening means;
   plunger means in said housing means for dispensing the contents of said cartridge means;
   control knob means on said housing means;
   shaft means rigidly connected to said control knob means transversely extending within said housing means and mounted for rotary and axial movement;
   stem means attached to said plunger means;
   rack means on said stem means;
   a pinion means mounted for rotation with said shaft means whereby rotation of the said pinion means in engagement with said rack means will provide axial movement of said plunger means; and
   means connected to said control knob means for actuating said door means.

2. The dispenser of claim 1, wherein said housing means comprises an upper housing portion removably connected to a lower housing portion.

3. The dispenser of claim 2, wherein said control knob means extend from a front face of said top housing portion.

4. The dispenser of claim 2, further comprising sight glass means on said bottom housing portion.

5. The dispenser of claim 1, wherein said control knob means has a circular periphery provided with indicia and an indicator is provided on said housing means for cooperation with said indicia for indicating a quantity of the contents of said refill cartridge means to be dispensed.

6. The dispenser of claim 1, wherein said plunger stem has a centrally disposed axial bore; and
   an elongated rod connected to a top inner wall of said housing means slidably received within said plunger stem bore.

7. The dispenser of claim 1, further comprising spring means for axially outwardly biasing said shaft means.

8. The dispenser of claim 7, wherein said door means comprises a thin flat flexible strip mounted for axial movement with said shaft means.

9. The dispenser of claim 8, further comprising channel means within said housing constraining said door means for sliding movement between an open and a closed position.

10. A dispenser for soap, shampoo, tooth paste and the like, comprising:

a generally rectangular housing;

said housing having a removable top portion joined with a bottom portion;

means on said bottom portion for mounting said dispenser on the wall;

a generally cubical disposable refill cartridge removably received within said bottom housing portion;

said refill cartridge having an axially slidable bottom wall and an aperture in an opposed front wall;

a generally rectangular plunger abutting said refill cartridge back wall;

a dispensing opening on a bottom wall of said bottom housing portion in registry with said refill cartridge aperture;

an axially extending stem rigidly secured to said plunger;

said stem having a central bore;

a rod slidably received within the central bore of said stem and secured to an inner top wall of said upper housing portion;

a gear rack formed on said stem;

a transversely extending shaft mounted for axial and rotary movement in said upper housing portion;

a pinion mounted for rotation with said shaft;

one end of said shaft extending through an opening in a front face of said upper housing portion;

a spring abutting an opposite end of said shaft and an inner wall of a back face of said upper housing portion;

a circular control knob on said front face of said upper housing portion rigidly secured to said shaft;

indicia formed around the periphery of said control knob;

an indicating pointer on said front face of said upper housing portion adjacent said control knob;

a door formed from a thin flat strip of flexible resilient material having one end rigidly attached to said shaft; and said door having an opposite end slidably disposed between said refill cartridge aperture and said dispenser opening for selective movement between open and closed positions.

* * * * *